US007574966B1

(12) United States Patent
Stephens et al.

(10) Patent No.: US 7,574,966 B1
(45) Date of Patent: Aug. 18, 2009

(54) PORTABLE VOTING BOOTH AND LEG-HOLDING STRUCTURE

(76) Inventors: Richard J. Stephens, 29751 Valley Center Rd., Valley Center, CA (US) 92082; Horst B. Krippner, 780 Mason Rd., Vista, CA (US) 92084

( * ) Notice: Subject to any disclaimer, the term of this patent is extended or adjusted under 35 U.S.C. 154(b) by 0 days.

(21) Appl. No.: 11/982,072

(22) Filed: Nov. 1, 2007

(51) Int. Cl.
*A47B 11/00* (2006.01)

(52) U.S. Cl. ..... 108/157.1; 108/38; 108/156; 248/188

(58) Field of Classification Search ..... 108/157.1, 108/156, 157.17, 158.11, 34, 38, 106, 181, 108/158.12, 158.13, 159; 248/188, 188.2, 248/188.5, 188.8, 188.9, 151, 109.8; 403/329, 403/109.3, 290, 291, 397, DIG. 14
See application file for complete search history.

(56) References Cited

U.S. PATENT DOCUMENTS

| | | | | | |
|---|---|---|---|---|---|
| 2,644,475 | A | * | 7/1953 | Morton | 135/33.5 |
| 3,333,766 | A | | 8/1967 | Crossland et al. | |
| 3,389,947 | A | | 6/1968 | Kelley et al. | |
| 3,620,587 | A | | 11/1971 | Ahmann | |
| 3,806,219 | A | | 4/1974 | Ahmann | |
| 3,865,050 | A | * | 2/1975 | Cecchetti | 108/19 |
| 4,011,821 | A | * | 3/1977 | Neal | 108/156 |
| 4,383,488 | A | * | 5/1983 | Macho et al. | 108/129 |
| 4,396,177 | A | * | 8/1983 | Liebl | 248/615 |
| 4,445,731 | A | | 5/1984 | Ahmann | |
| 4,574,709 | A | * | 3/1986 | Lackey et al. | 108/11 |
| 4,627,543 | A | * | 12/1986 | Nicely | 211/187 |
| 4,712,757 | A | | 12/1987 | Ahmann | |
| 4,749,163 | A | * | 6/1988 | Mestdagh | 248/615 |
| 4,760,802 | A | * | 8/1988 | Leong | 108/157.16 |
| 4,762,437 | A | * | 8/1988 | Mitomi | 403/11 |
| 4,852,837 | A | * | 8/1989 | Merten et al. | 248/188 |
| 4,887,536 | A | * | 12/1989 | Teichner | 108/35 |
| 5,353,716 | A | * | 10/1994 | Wilbert | 108/150 |
| 5,438,938 | A | * | 8/1995 | Meeker et al. | 108/91 |
| 5,509,376 | A | * | 4/1996 | Tsengas | 119/51.5 |
| 5,556,181 | A | * | 9/1996 | Bertrand | 312/313 |
| D378,173 | S | | 2/1997 | Hobson | |
| 5,651,632 | A | * | 7/1997 | Gordon | 403/319 |
| 5,666,765 | A | | 9/1997 | Sarner et al. | |
| 6,460,471 | B1 | * | 10/2002 | Yang | 108/156 |
| 6,485,213 | B1 | * | 11/2002 | Viale | 403/12 |

(Continued)

FOREIGN PATENT DOCUMENTS

GB 2190282 A * 11/1987

*Primary Examiner*—José V Chen
(74) *Attorney, Agent, or Firm*—Loyal McKinley Hanson

(57) ABSTRACT

A portable voting booth for a user to erect at a voting place when needed and disassemble thereafter for transportation and storage includes a base portion and a plurality of legs for assemble onto the base portion. The base portion defines a plurality of leg-receiving bores for receiving hollow tubular end portions of the plurality of legs. The base portion also includes leg-gripping components within the bores for gripping the tubular end portions in order to restrain the legs from falling out of the leg-receiving bores under influence of gravity. The leg-gripping components of one embodiment include four resiliently deformable, axially extending fingers within each of four leg-receiving bores, the fingers resiliently deforming so that they fit axially into the tubular end portions to bear radially outward against the inwardly facing inner walls of the tubular end portions for leg-restraining purposes.

16 Claims, 8 Drawing Sheets

U.S. PATENT DOCUMENTS 6,712,010 B2 * 3/2004 Bartz et al. ..... 108/157.1
6,786,669 B2 * 9/2004 Tsui et al. ..... 403/322.2
6,827,262 B2 12/2004 McClure et al.
6,880,709 B2 * 4/2005 Chen ..... 211/70.6
6,925,945 B2 * 8/2005 Babick et al. ..... 108/157.1
6,976,434 B2 * 12/2005 Roig et al. ..... 108/25

* cited by examiner

Prior
Art

PORTABLE VOTING BOOTH AND LEG-HOLDING STRUCTURE

BACKGROUND OF THE INVENTION

1. Technical Field

This invention relates generally to the field of voting and balloting equipment, and more particularly to a portable voting booth and the construction of a leg-holding portion of the voting booth.

2. Description of Related Art

Some existing portable voting booths take the form of a suitcase-like enclosure with two hinged-together sections that remain closed for storage and transportation while opening about ninety-degrees for use on election day. In the open configuration, the first section provides a base having an upwardly facing surface upon which voters mark ballots or other vote-recording paraphernalia, with the second section serving as an upstanding rear wall of the voting booth. Two panels are included in the enclosure for use as upstanding left and right side walls that provide additional voting-booth privacy.

The enclosure also contains a set of four, multi-section, tubular legs. A worker at a polling place erects the voting booth by first assembling the leg sections. Next, the worker inserts an end portion of each leg axially into a respective one of four downwardly opening, leg-receiving bores (also referred to as sockets) that are included for that purpose at the four corners of the base. With the end portions of the legs inserted into the sockets and the base in a ready-to-use position parallel to a floor or other horizontal support surface, the legs extend downwardly from the base in order to thereby elevate the base above the floor. Voters cast their votes using the upwardly facing support surface of the base while standing at the voting booth.

Although such a portable voting booth can be quite handy and effective in many respects, the tubular legs sometimes drop out of their sockets during erection. This also tends to happen during movement of an already erected voting booth to a different location at a polling place. Dimensional variations are often the cause. Each socket typically includes a cylindrically shaped inner wall that defines an opening into which one of the legs is inserted. The cylindrical wall is dimensioned to receive the end portion of the tubular leg in a close fit. As long as the end portion of the leg fits in somewhat tightly, the leg stays in place. When the fit is too loose, however, the leg can easily drop out.

Although the effect of gravity tends to hold the voting booth together once it is erected in an upright position, the task of inserting the legs into the sockets and then positioning the voting booth in the upright position can be quite frustrating. This problem can be even more troublesome to the senior-citizen workers commonly seen working at voting places. Thus, a need exists for a portable voting booth that overcomes this problem.

SUMMARY OF THE INVENTION

In view of the foregoing, it is an object of the present invention to provide a portable voting booth with a leg structure that overcomes the problem outlined above. The present invention achieves this objective by providing a portable voting booth having a base portion with leg-receiving sockets and one or more leg-gripping components within each leg-receiving socket. Preferably, the leg-gripping components include axially extending fingers that resiliently deform slightly when tubular end portions of the legs are inserted into the sockets to thereby fit into the end portions. The fingers bear radially outward against radially inwardly facing inner walls of the end portions to thereby hold the legs in place. No screws, clips, or other fasteners are required.

To paraphrase some of the more precise language appearing in the claims and further introduce the nomenclature used, the invention provides a portable voting booth for a user to erect at a voting place when needed and disassemble thereafter for transportation and storage. The portable voting booth includes a base portion and a plurality of legs for assembly to the base portion in order to support the base portion in an elevated position on a horizontal support surface. A user assembles the legs onto the base portion as a step in erecting the portable voting booth.

The base portion defines a plurality of leg-receiving bores (i.e., sockets) for receiving the plurality of legs, including at least a first leg-receiving bore. The base portion also includes first leg-gripping means within the first leg-receiving bore for gripping a first end portion of a first leg of the plurality of legs. That is done in order to thereby restrain the first leg from falling out of the first leg-receiving bore under influence of gravity. Preferably, the plurality of legs includes four legs, the base portion includes four leg-receiving bores, and four leg-gripping means are provided, one within each of the four leg-receiving bores.

More specifically, with reference to just a first one of the legs, it has a first end portion that is tubularly shaped with a hollow interior defined by a radially inwardly facing inner wall of the first end portion. The base portion includes a first one of the leg-receiving bores defined by a first bore-defining wall of the base portion, and a first one of the leg-gripping means includes at least a first resiliently deformable member located within the first bore. The first resiliently deformable member is adapted to resiliently deform and move radially away from the first bore-defining wall under force from the first end portion of the first leg when the first end portion is inserted axially into the first bore in order to thereby fit into the hollow interior of the first end portion as the first end portion is advance further into the first bore. The first resiliently deformable member bears radially outward against the radially inwardly facing inner wall of the first end portion of the first leg in order to thereby restrain the first leg from falling out of the first bore under influence of gravity.

Preferably, the first leg-gripping means includes four resiliently deformable, axially extending members located within the first bore in circumferentially spaced-apart positions. Preferably, the first end portion of the first leg and the inwardly facing wall that defines the first bore are cylindrically shaped. In one form of the invention, the base portion includes a blow-molded portion and four injection-molded, bore-defining components held by the blow-molded portion. In that case, each bore-defining component includes a rigid body of material having a bore-defining wall that defines a leg-receiving bore (i.e., a socket) extending along a bore axis from an open end of the bore to a closed end of the bore. The bore-defining components include leg-gripping means within the leg-receiving bores so defined.

Thus, the invention provides a portable voting booth having one or more leg-gripping components within each downwardly opening leg-receiving bore. Leg-gripping components resiliently deform radially in order to slide into the ends of the tubular legs as the legs are inserted into the leg-receiving bores, bearing radially outward against the radially inwardly facing inner walls of the end portions of the legs to thereby hold the legs in place, with no screws, clips, or other fasteners being required. The following illustrative drawings and detailed description make the foregoing and other objects, features, and advantages of the invention more apparent.

DESCRIPTION OF THE PREFERRED EMBODIMENTS

Figure 1:
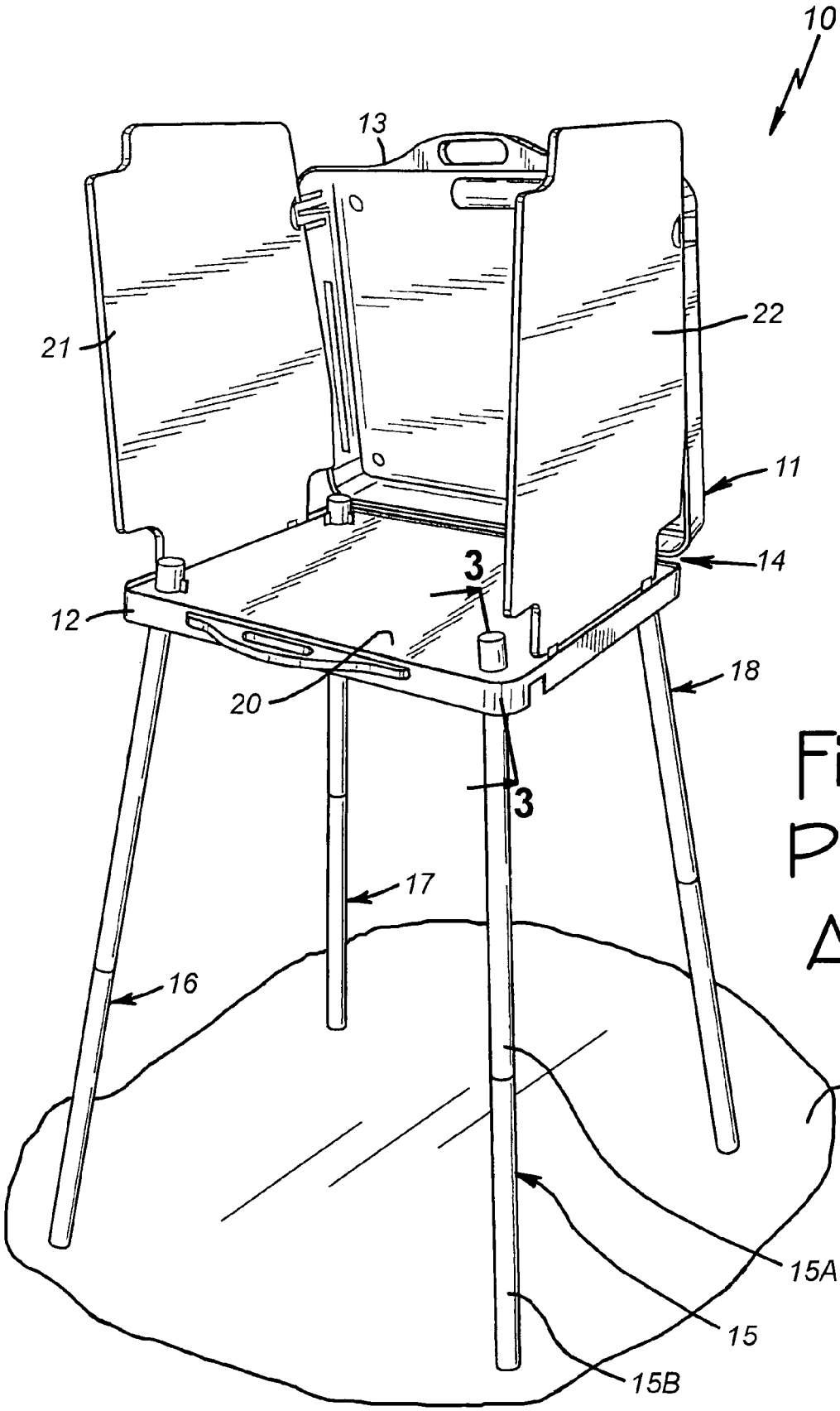
FIG. 1 of the drawings is a perspective view of an erected portable voting booth constructed according to the prior art.
Figure 2:
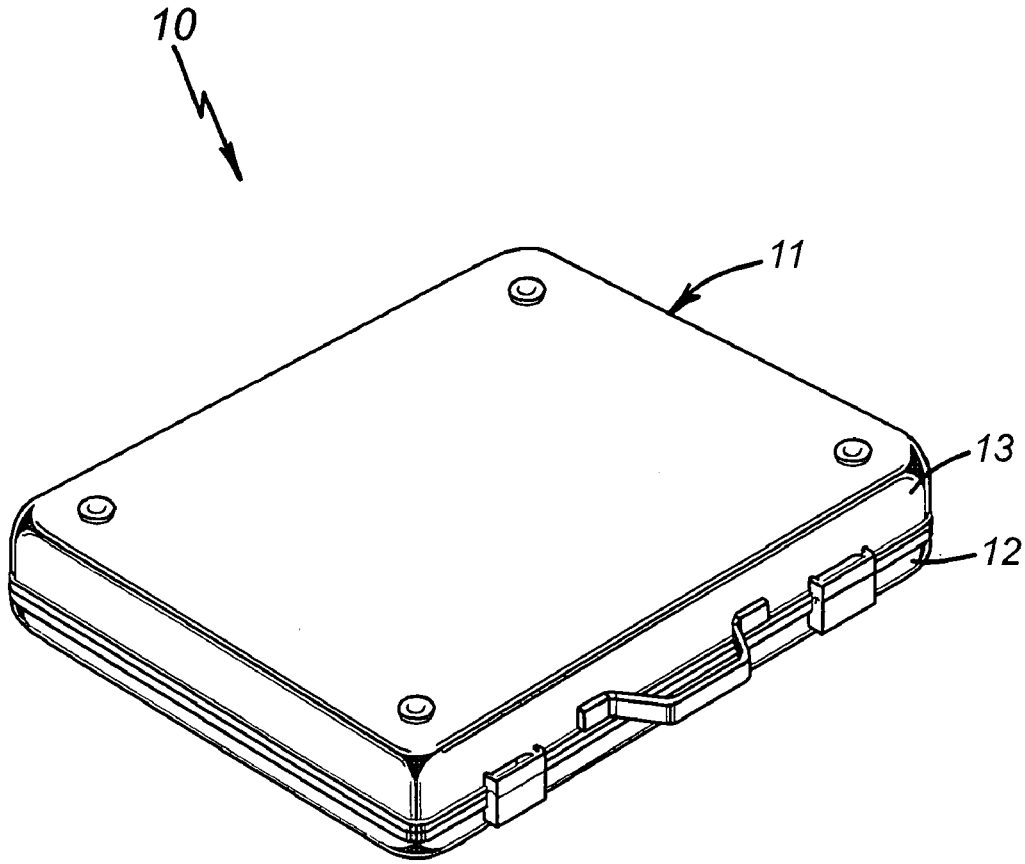
Fig. 2 Prior Art
FIG. 2 is another view of the prior art portable voting booth shown in a closed, suitcase-like configuration.

FIGS. 1, 2, and 3 of the drawings show various aspects of a portable voting booth 10 constructed according to the prior art. Generally, the prior art portable voting booth 10 includes a suitcase-like enclosure 11 (FIGS. 1 and 2) having a first section 12 (i.e., a base portion 12) and a second section 13 (an upstanding rear wall 13). The enclosure 11 includes a hinged portion 14 that enables a user to open and close the enclosure 11, between the fully erected open configuration shown in FIG. 1 and the closed configuration used for transportation and storage shown in FIG. 2.

A worker erects the portable voting booth 10 to the open configuration by assembling four multi-section legs 15, 16, 17, and 18 onto the base portion 12 of the enclosure 11. First and second leg sections 15A and 15B of the first leg 15 (FIG. 1) fit together telescopingly to form the first leg 15. The third, fourth, and fifth legs 16, 17, and 18 are similar to the first leg 15. With the legs set upon a floor 19 or other horizontal support surface, an upwardly facing surface 20 on the base portion 12 provides a horizontal work surface that is elevated by the legs 15-18 about three to four feet, more or less, above the floor 19. A voter (not shown) can mark a while standing at the portable voting booth 10. Left and right side walls 21 and 22 are moved during erection to the upstanding positions shown in FIG. 1 to provide additional privacy for the voter.

Figure 3A:
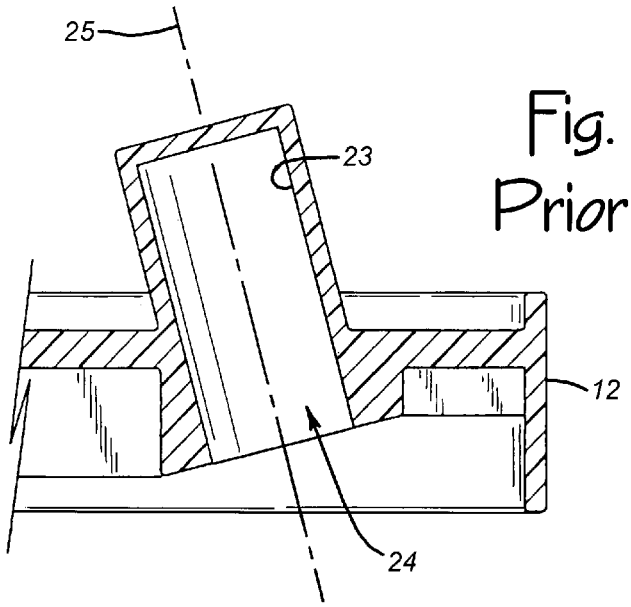
Fig. 3a Prior Art
FIGS. 3*a* and 3*b* of the drawings are enlarged cross-sectional views of part of the base portion of the prior art portable voting booth, as viewed in a vertical plane containing a line 3-3 in FIG. 1, with FIG. 3*a* showing the leg-receiving bore without a leg and FIG. 3*b* showing the leg-receiving bore with a leg inserted in it.
Figure 3B:
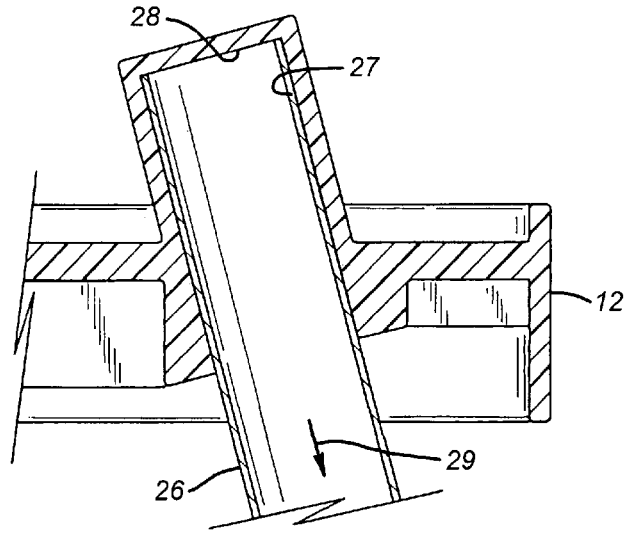
Fig. 3b Prior Art

FIGS. 3*a* and 3*b* are cross sections of the base portion 12 as viewed in a vertical plane containing a line 3-3 in FIG. 1, and they show details of the prior art leg-holding structure of the portable voting booth 10 with reference to a first one of four leg-holding structures of the voting booth 10. The base portion 12 of the voting booth 10 includes a cylindrically shaped, bore-defining wall 23 that defines a downwardly opening, leg-receiving, first bore 24 extending along a bore axis 25 (FIG. 3*a*). A worker assembles a first leg 26 on the base portion 12 by inserting a first end portion 27 of the first leg 26 into the first bore 24 until the first end portion 27 abuts or nearly abuts a closed end 28 of the first bore 24 (FIG. 3*b*). The first leg 26 may, for example, take the form of a forty-inch long, cylindrical metal tube having a one-inch outside diameter. If the first bore 24 has a diameter providing a close enough fit for the first end portion 27 of the first leg 26, friction retains the first end portion 27 within the first bore 24 against the effect of gravity. If the fit of the first end portion 27 in the first bore 24 is not sufficiently tight, however, the first end portion 27 of the first leg 26 can fall out of the bore 24 under influence of gravity as depicted by an arrow 29 in FIG. 3*b*.

Figure 4A:
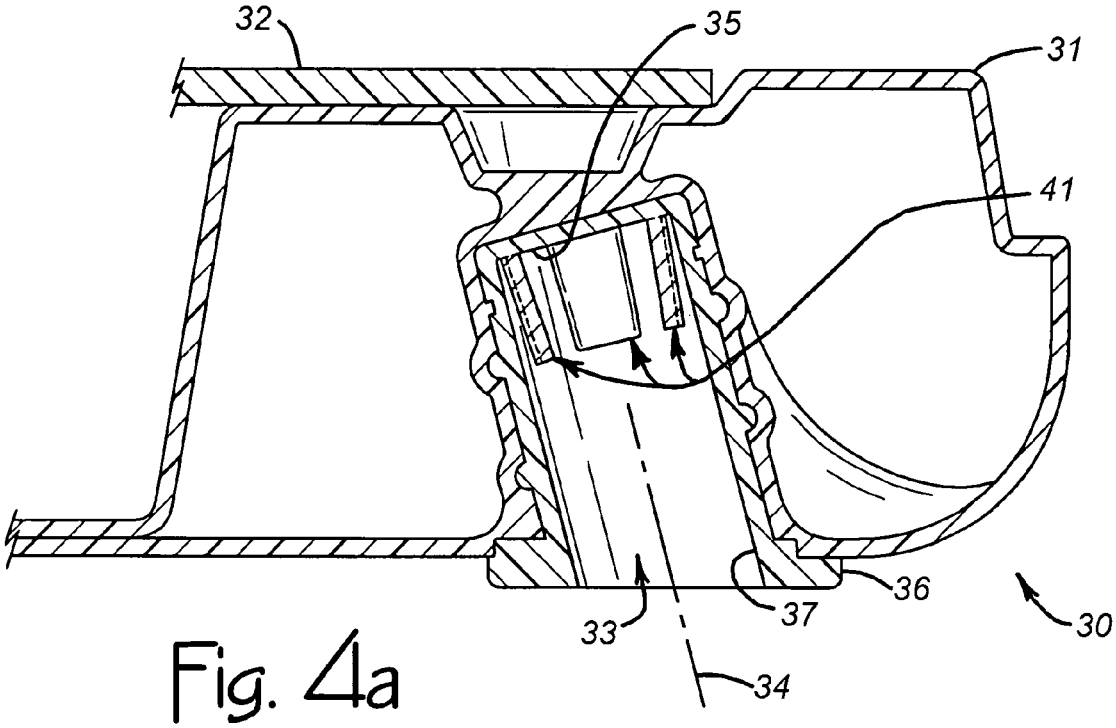
FIGS. 4*a* and 4*b* are enlarged cross-sectional views, similar to FIGS. 2*a* and 2*b*, of a portion of a portable voting booth constructed according to the present invention using bore-defining components, with FIG. 4*a* showing a first one of the bore-defining components without a leg and FIG. 4*b* showing the first bore-defining component with a leg inserted in it.
Figure 4B:
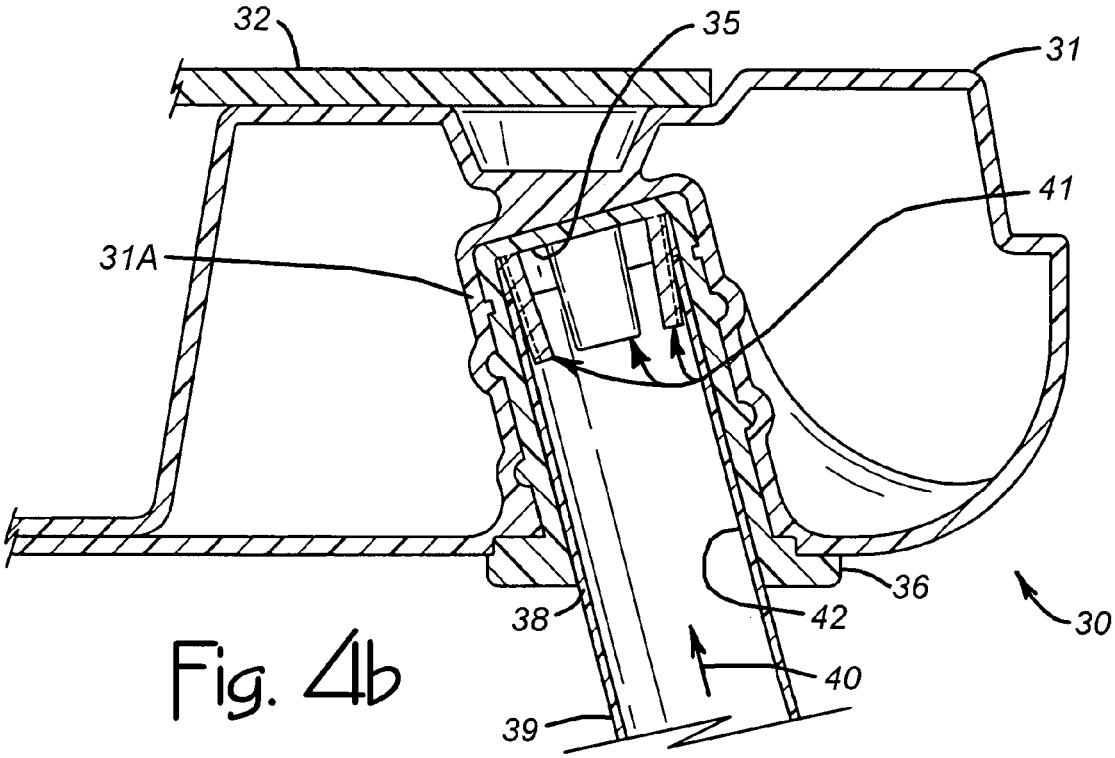

Turning now to FIGS. 4*a* and 4*b*, they show various details of a portable voting booth 30 constructed according to the instant invention. The voting booth 30 may be similar in many respects to the prior art voting booth 10 and so FIGS. 1, 2, 3*a*, and 3*b* may be referred to for the features they may have in common. The voting booth 30 is portable in the sense that it has legs that can be manually assembled on a base portion when needed and thereafter disassembled for transportation and storage. Preferably, the voting booth 30 includes a suitcase-like enclosure similar in some respects to the prior art enclosure 11 described above. The voting booth 30 includes a base portion 31 having an upwardly facing support surface 32 that a voter can use. Preferably, the voting booth 30 includes multi-section legs that can be stored in the enclosure and assembled when needed into four, forty-inch long, cylindrical metal tubes having one-inch outside diameters and 0.0625-inch wall thicknesses. Unlike the prior art voting booth 10, however, the voting booth 30 includes leg structures that help alleviate the problem of the legs tending to fall out of their sockets.

The four leg structures of the voting booth 30 include four bore-defining portions of the base portion 31 that receive the four legs and hold them in place. The four leg structures are similar and so only a first one of the four is described in further detail. As shown in FIG. 4*a*, the base portion 31 defines a downwardly opening, leg-receiving, first bore 33 that extends along a first bore axis 34 to a closed upper end 35 of the first bore 33. The base portion 31 includes four such leg-receiving bores and four legs for mounting in the four bores as a step in erecting the voting booth 30. As with the prior art voting booth 10, the four legs of the voting booth 30 elevate the support surface 32 so that a voter can use the support surface 32 while standing at the voting booth 30. Of course, shorter legs can be used when desired without departing from the inventive concepts described (e.g., using just one section of each leg in order to lower the support surface 32 for use by voters in wheel chairs). In addition, legs and bores with rectangular cross sections may be used instead of the illustrated cylindrically shaped legs and leg-receiving bores.

For the illustrated voting booth 30, the base portion 31 includes four bore-defining components similar to a first bore-defining component 36 in FIGS. 4*a* and 4*b*. The first bore-defining component 36 is composed of an injection molded plastic and it is held in place by a surrounding blow-molded portion 31B of the base portion 31. That arrangement provides the cost, convenience, and weight benefits of a blow-molded enclosure along with the strength and durability of injection-molded bore-defining components.

The first bore-defining component 36 includes a cylindrically shaped, bore-defining wall 37, and it is that bore-defining wall 37 that defines the first bore 33. More specifically, the component 36 is a rigid body of material having a bore-defining wall 37 that defines the leg-receiving bore 33 extending along a bore axis from an open end of the bore to a closed end of the bore, said leg-receiving bore being adapted to receive a tubular end portion of a voting booth leg. Erection of the voting booth 30 includes inserting a first end portion 38 of a first leg 39 into the first bore 33, as indicated by an arrow 40 in FIG. 4*b*. As that is done, multiple fingers of a first leg-gripping component 41 bear against a radially inwardly facing inner wall 42 of the first end portion 38 of the first leg 39 to thereby hold the first leg 39 in place so that it is less likely to fall out of the first bore 33 under influence of gravity.

Figure 5:
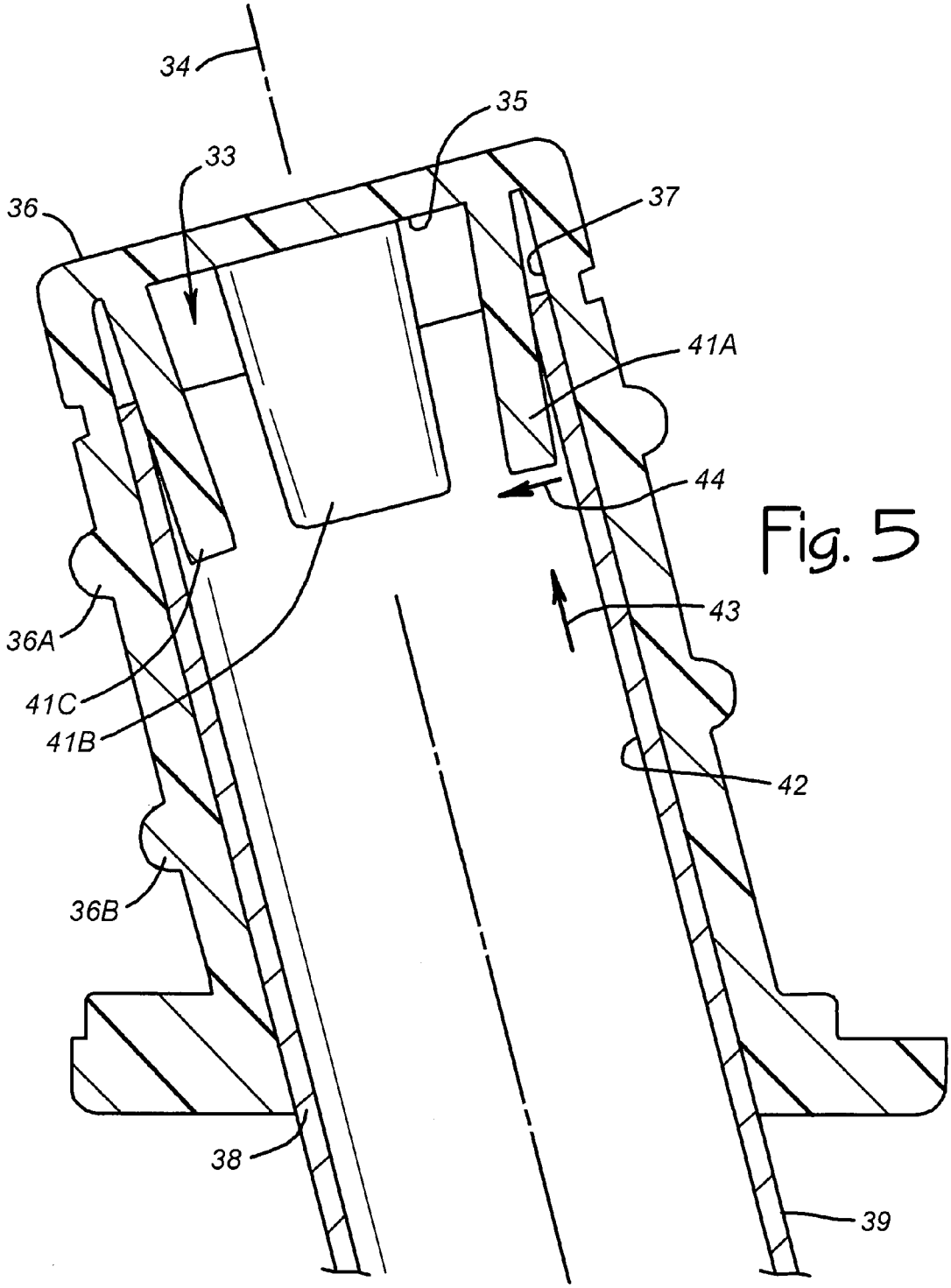
FIG. 5 is a further enlarged cross-sectional view of the first bore-defining component and the first leg.

FIG. 5 shows a portion of FIG. 4*b* that has been enlarged for illustrative purposes to make it easier to see the various parts of the first bore-defining component 36 and the gripping action of the first leg-gripping component 41 on the first end portion 38 of the first leg 39. The first bore-defining component 36 includes the first leg-gripping component 41 identified in FIGS. 4*a* and 4*b*, with the first leg-gripping component 41 including four axially extending members or fingers. Just a first, second, and third finger 41A, 41B, and 41C are visible in FIG. 5. The four fingers of the leg-gripping component 41 are similar to each other and so only further details of the first finger 41A are described in further detail.

The first bore-defining component 36 is composed of an injected molded plastic material and it includes annular ribs 36A and 36B that the blow-molded portion 31A of the base portion 31 grips. In terms of size, the first bore-defining component 36 is about two inches long measured along the first bore axis 34, while the first finger 41A is about one-half inch long measured parallel to the first bore axis. The illustrated first bore 33 has a diameter of about 1.05 inches so that the one-inch outside diameter of the first end portion 38 of the leg 39 fits easily into the first bore 33. In addition, the first finger 41A is spaced apart from the bore-defining wall 37 by an amount less than the wall thickness of the tubular end portion 38 (e.g., less than about 0.0625 inches for the illustrated leg 39).

When the first end portion 38 of the first leg 39 is moved axially into the first bore 33 (as indicated by an arrow 43 in FIG. 5), the first end portion 38 slides axially in between the first finger 41A and the bore-defining wall 37 while exerting radially inwardly directed force against the first finger 41A. That causes the first finger 41A to resiliently deform radially inwardly away from the bore-defining wall 37 (as indicated by an arrow 44 in FIG. 5) while bearing radially outwardly against the inner wall 42 of the first end portion 38. The first finger 41A resiliently deforms that way sufficiently to enable the first end portion 38 to be advanced to the position illustrated in FIG. 5. The first finger 41A bears radially outwardly against the inner wall 42 of the first end portion 38 and thereby holds the leg 39 in place in order to help prevent it from falling out of the bore 33 under influence of gravity.

Figure 6:
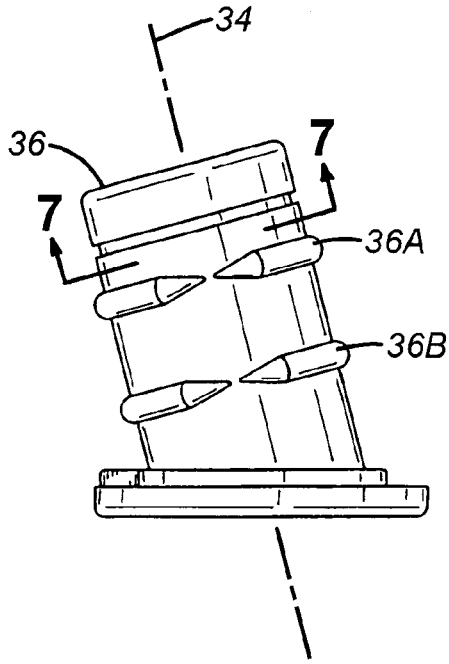
FIG. 6 is an elevation view of the first bore-defining component.
Figure 7:
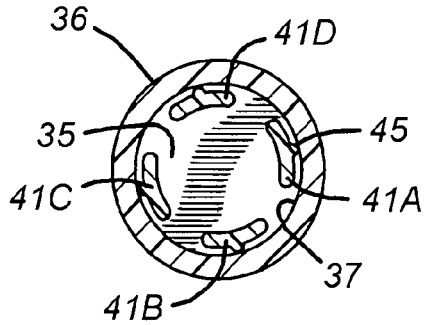
FIG. 7 is a cross sectional view of the first bore-defining component as viewed in a plane perpendicular to the bore axis in FIG. 6 that contains a line 7-7.

FIGS. 6 and 7 show the first bore-defining component 36 by itself. FIG. 6 is an elevation view and FIG. 7 is a cross section as viewed in a plane perpendicular to the first bore axis 34 that contains a line 7-7 in FIG. 6. All four leg-gripping fingers 41A, 41B, 41C, and 41D are visible in FIG. 7. Notice in FIG. 7 that the four illustrated leg-gripping fingers include axially extending ribs that contact the first bore-defining wall 37 (e.g., an axially extending rib 45 on the first finger 41A). The first end portion 38 slides in between the rib 45 and the bore-defining wall 37 as it moves axially to the position described earlier with reference to FIG. 5.

Figure 8:
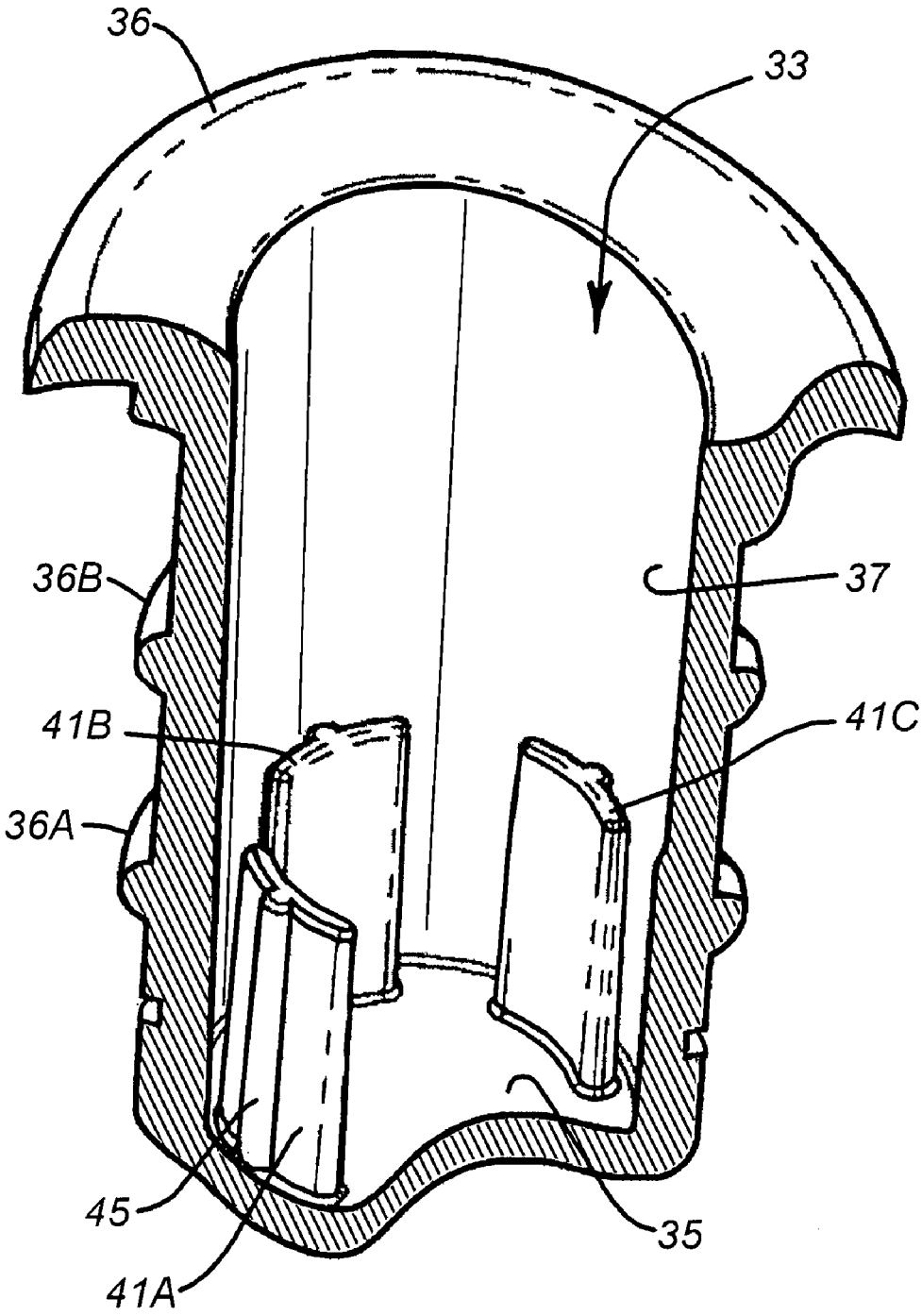
FIG. 8 is an enlarged, inverted, cross-sectional perspective view of the first bore-defining component showing three of the four, resiliently deformable, leg-gripping members.

FIG. 8 provides an enlarged perspective view of the first bore-defining component 36, shown in cross section and in an inverted position for illustrative purposes (i.e., the downwardly opening bore 33 is illustrated facing upwardly). The rib 45 of the first finger 41A is more easily discerned in FIG. 8. Like the ribs on the other three fingers (the fourth finger 41D is not visible in FIG. 8), the rib 45 extends radially from the rest of the first finger 41A toward the first bore-defining wall 37, with the first finger 41A resiliently deforming radially inwardly (away from the bore-defining wall 37) when the first end portion 38 of the first leg 39 is advanced axially in between the rib 45 and the bore-defining wall 37.

Second Embodiment

Figure 9:
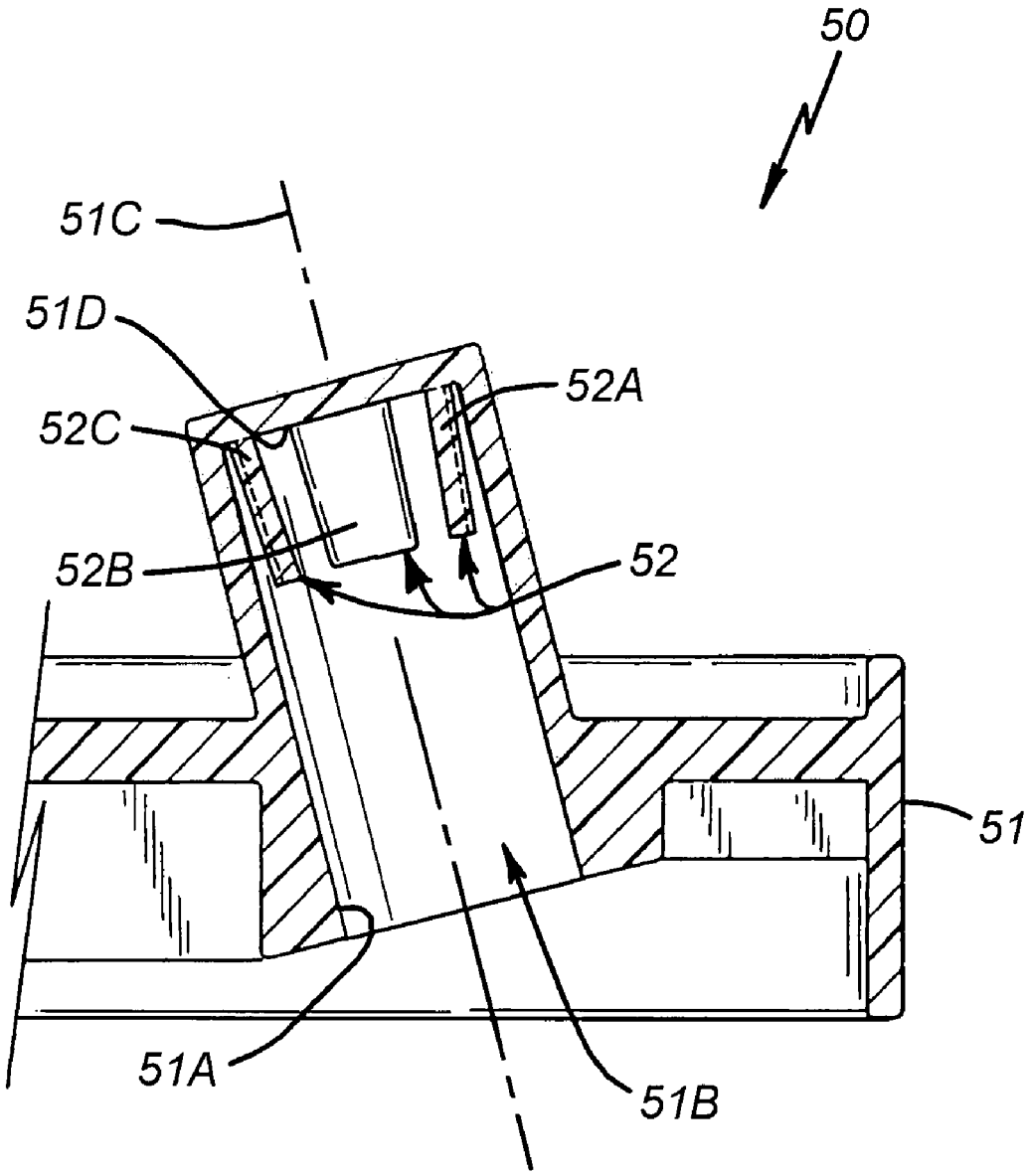
FIG. 9 is a cross-sectional view, similar to FIG. 4*b*, of a portion of the base of a second embodiment of the invention in which the leg-receiving bores and leg-gripping members are formed as integral parts of the base without using bore-defining components.

Now consider FIG. 9. It shows a base portion 51 of a second embodiment of a portable voting booth 50 constructed according to the invention. The base portion 51 in FIG. 9 may be similar in some respects to the base portion 12 of the prior art portable voting booth 10 shown in FIG. 3*a*; it includes a first bore-defining wall 51A that defines a downwardly opening first bore 51B extending along a first bore axis 51C to a closed end 51D, and the bore 51B is sized to receive the first end portion 38 of the first leg 39 as discussed previously with reference to the base portion 31 and FIGS. 4*a* and 4*b*. The base portion 51 is different from the prior art base portion 12, however, in that it includes a first leg-gripping component 52 that is similar to the first leg-gripping component 41 of the base portion 31 shown in FIGS. 4*a* and 4*b*. The first leg-gripping component 52 includes four axially extending, resiliently deformable members (i.e., fingers) that grip the first end portion 38 of the leg 39 (just three fingers 52A, 52B, and 53B are visible in FIG. 9).

Unlike the base portion 31 of the portable voting booth 30, the base portion 51 of the second embodiment 50 does not include a bore-defining component similar to the first bore-defining component 36 (i.e., one that includes the leg-gripping component 52.) Instead, the first leg-gripping component 52 is molded with the base portion 51 as an integral part of the base portion 51. Doing so foregoes the benefits of a blow-molded portion of the base portion that holds injection-molded socket members (e.g., the first bore-defining component 36), but it is another way of constructing a portable voting booth according to the broader inventive concepts of the invention.

Thus, the invention provides a portable voting booth having one or more leg-gripping components within each of multiple downwardly opening leg-receiving bores. The leg-gripping components resiliently deform radially in order to slide into the ends of the tubular legs as the legs are inserted into the leg-receiving bores, bearing radially outward against the end portions of the legs in order to thereby hold the legs in place, with no screws, clips, or other fasteners being required. Although exemplary embodiments have been shown and described, one of ordinary skill in the art may make many changes, modifications, and substitutions without necessarily departing from the spirit and scope of the invention. One of ordinary skill in the art can readily apply the invention to any table or bench that has a base component and tubular legs that can be assembled in the manner of the voting booth herein described; as used herein, the word "table" includes benches and table-like and bench-like structures having a base component supported by multiple legs. As for the specific terminology used to describe the exemplary embodiments, it is not intended to limit the invention; each specific term is intended to include all technical equivalents that operate in a similar manner to accomplish a similar purpose or function. "Downwardly opening" bores, for example, means that the bores open downwardly when the base portion is spatially oriented so that the upwardly facing surface on the base portion is horizontally disposed and facing upwardly away from the floor or other horizontal support surface.

What is claimed is:

1. A portable voting booth for a user to erect at a voting place when needed and disassemble thereafter for transportation and storage, the portable voting booth comprising:

a base portion; and means for supporting the base portion on a horizontal support surface so that the base portion is elevated above the horizontal support surface, said means including a plurality of legs for the user to assembly onto the base portion as a step in erecting the portable voting booth and said plurality of legs including at least a first leg having a first end portion that is tubularly shaped with a wall thickness and an inwardly facing wall that defines a hollow interior of the first end portion;

wherein the base portion defines a plurality of leg-receiving bores for receiving the plurality of legs, said plurality of leg-receiving bores including at least a first leg-receiving bore that extends along a first bore axis from an open end of the first bore to a closed end of the first bore, and said base portion including a first bore-defining wall that defines the first leg-receiving bore;

wherein the base portion includes first leg-gripping means within the first leg-receiving bore for gripping the first end portion of the first leg in order to thereby restrain the first leg from falling out of the first leg-receiving bore under influence of gravity;

wherein the first leg-gripping means includes a plurality of axially extending fingers that extend axially within the first leg-receiving bore toward the open end of the bore where they resiliently deform radially inward slightly when the first end portion of the first leg is inserted into the first leg-receiving bore in order to thereby fit into the first end portion:

said plurality of axially extending fingers including at least a first resiliently deformable member within the first leg-receiving bore that is proximally spaced apart radially from the bore-defining wall less than the wall thickness of the first end portion of the first leg and that is adapted to resiliently deform and move radially away from the first bore-defining wall relative to the first bore axis under force from the first end portion of the first leg while extending axially into the first end portion of the first leg when the first end portion is inserted axially into the first bore; and wherein said first resiliently deformable member is adapted to fit into the hollow interior of the first end portion of the first leg as the first end portion is advance further into the first bore, and to bear radially outward against the inwardly facing wall of the first end portion with increasing force as the first end portion is advanced into the first leg-receiving bore in order to thereby restrain the first leg from falling out of the first bore under influence of gravity.

2. A portable voting booth as recited in claim 1, wherein the plurality of legs includes four legs, the base portion includes four leg-receiving bores, and the base portion includes four leg-gripping means, with each of said leg-gripping means being within a respective one of the four leg-receiving bores.

3. A portable voting booth as recited in claim 1, wherein the first leg-gripping means includes a plurality of resiliently deformable, axially extending members within the first bore in circumferentially spaced-apart positions.

4. A portable voting booth as recited in claim 1, wherein the first leg-gripping means includes four resiliently deformable, axially extending members within the first bore in circumferentially spaced-apart positions.

5. A portable voting booth as recited in claim 1, wherein an exterior surface of the first end portion of the first leg and the first bore-defining wall of the base portion are cylindrically shaped.

6. A portable voting booth as recited in claim 1, wherein the base portion includes a molded portion and a plurality of bore-defining components held by the molded portion.

7. A portable voting booth as recited in claim 6, wherein the plurality of bore-defining components includes at least a first bore-defining component that defines the first leg-receiving bore, and the first bore-defining component includes the first leg-gripping means.

8. A portable voting booth as recited in claim 1, wherein the base portion of the portable voting booth includes a molded portion and four bore-defining components held by the molded portion.

9. A portable voting booth as recited in claim 1, wherein the base portion of the portable voting booth includes a blow-molded portion and four injection-molded components held by the blow-molded portion that define four leg-receiving bores.

10. A table for a user to erect when needed and disassemble thereafter for transportation and storage, the table comprising:

a base portion; and means for supporting the base portion on a horizontal support surface so that the base portion is elevated above the horizontal support surface, said means including a plurality of legs for the user to assembly onto the base portion as a step in erecting the portable voting booth and said plurality of legs including at least a first leg having a first end portion that is tubularly shaped with a wall thickness and an inwardly facing wall that defines a hollow interior of the first end portion;

wherein the base portion defines a plurality of leg-receiving bores for receiving the plurality of legs, said plurality of leg-receiving bores including at least a first leg-receiving bore that extends along a first bore axis from an open end of the first bore to a closed end of the first bore, and said base portion including a first bore-defining wall that defines the first leg-receiving bore;

wherein the base portion includes first leg-gripping means within the first leg-receiving bore for gripping the first end portion of the first leg in order to thereby restrain the first leg from falling out of the first leg-receiving bore under influence of gravity;

wherein the first leg-gripping means includes a plurality of axially extending fingers that extend axially within the first leg-receiving bore toward the open end of the bore where they resiliently deform radially inward slightly when the first end portion of the first leg is inserted into the first leg-receiving bore in order to thereby fit into the first end portion;

said plurality of axially extending fingers including at least a first resiliently deformable member within the first leg-receiving bore that is proximally spaced apart radially from the bore-defining wall less than the wall thickness of the first end portion of the first leg and that is adapted to resiliently deform and move radially away from the first bore-defining wall relative to the first bore axis under force from the first end portion of the first leg while extending axially into the first end portion of the first leg when the first end portion is inserted axially into the first bore; and wherein said first resiliently deformable member is adapted to fit into the hollow interior of the first end portion of the first leg as the first end portion is advance further into the first bore, and to bear radially outward against the inwardly facing wall of the first end portion with increasing force as the first end portion is advanced into the first leg-receiving bore in order to thereby restrain the first leg from falling out of the first bore under influence of gravity.

11. A table as recited in claim 10, wherein the plurality of legs includes four legs, the base portion includes four leg-receiving bores, and the base portion includes four leg-gripping means, with each of said leg-gripping means being within a respective one of the four leg-receiving bores.

12. A table as recited in claim 10, wherein the first leg-gripping means includes a plurality of resiliently deformable, axially extending members within the first bore in circumferentially spaced-apart positions.

13. A table as recited in claim 10, wherein the first leg-gripping means includes four resiliently deformable, axially extending members within the first bore in circumferentially spaced-apart positions.

14. A bore-defining component for a base portion of a portable voting booth, the bore-defining component comprising:

a rigid body of material having a bore-defining wall that defines a leg-receiving bore extending along a bore axis from an open end of the bore to a closed end of the bore, said leg-receiving bore being adapted to receive a tubular end portion of a voting booth leg that has a predetermined wall thickness;

leg-gripping means within the leg-receiving bore for gripping the tubular end portion of the voting booth lea as the tubular end portion is inserted axially into the open end of the bore in order to restrain the voting booth leg from falling out of the leg-receiving bore under influence of gravity;

wherein the leg-gripping means within the bore includes a plurality of axially extending fingers that extend axially within the leg-receiving bore away from the closed end of the bore and toward the open end of the bore where they resiliently deform radially inward slightly relative to the bore axis in order to thereby fit into the first end portion of the voting booth lea when the tubular first end portion is inserted axially into the open end of the bore in order to thereby fit into the first end portion;

said plurality of axially extending fingers including at least a first resiliently deformable, axially extending member within the leg receiving bore that is proximally spaced apart radially from the bore-defining wall less than the predetermined wall thickness of the tubular end portion of the voting both leg that is adapted to resiliently deform and move radially away from the bore-defining wall under force from the hollow tubular end portion of the voting booth leg when the hollow tubular end portion of the leg is inserted axially into the open end of the bore in order to thereby fit into the hollow tubular end portion; and wherein said resiliently deformable member is adapted to fit into the hollow interior of the tubular end portion as the tubular end portion is advance further into the leg-receiving bore, and to bear radially outward against an inwardly facing wall of the tubular end portion with increasing force as the first end portion is advanced into the first leg-receiving bore in order to thereby restrain the leg from falling out of the bore under influence of gravity.

15. A bore-defining component as recited in claim 14, wherein the bore-defining wall is cylindrically shaped.

16. A bore-defining component as recited in claim 14, wherein the leg-gripping means includes four resiliently deformable, axially extending members within the bore in circumferentially spaced-apart positions.

* * * * *